United States Patent [19]

Provencher

[11] Patent Number: 4,623,822

[45] Date of Patent: Nov. 18, 1986

[54] ELECTRODELESS DISCHARGE RESONANCE LAMP

[75] Inventor: Gerald M. Provencher, Omaha, Nebr.

[73] Assignee: InterNorth, Inc., Omaha, Nebr.

[21] Appl. No.: 654,395

[22] Filed: Sep. 26, 1984

[51] Int. Cl.[4] ..... H01J 7/46; H01J 7/26; H01J 41/12; H01J 17/22

[52] U.S. Cl. ..... 315/39; 315/111.01; 315/248; 313/231.71; 313/233

[58] Field of Search ..... 313/233, 231.71; 315/248, 111.01, 54, 39; 372/70

[56] References Cited

U.S. PATENT DOCUMENTS

| | | | |
|---|---|---|---|
| 3,641,389 | 2/1972 | Leidigh | 315/39 |
| 3,911,318 | 10/1975 | Spero et al. | 315/39 |
| 4,414,488 | 11/1983 | Hoffmann et al. | 315/39 |
| 4,425,653 | 1/1984 | Cutler | 372/70 |

FOREIGN PATENT DOCUMENTS

| | | | |
|---|---|---|---|
| 2439961 | 7/1975 | Fed. Rep. of Germany | 313/231.71 |

*Primary Examiner*—David K. Moore
*Assistant Examiner*—M. Razavi
*Attorney, Agent, or Firm*—Donald F. Haas

[57] ABSTRACT

An electrodeless discharge resonance lamp for producing light by microwave excitation of gas molecules is disclosed. The lamp comprises a head having a passage therethrough and a gas inlet port in communication with the passage. A window is removable mounted in the passage and a collimator is removably mounted in the passage adjacent and exterior to the window. Gas flow tubing is positioned in the passaged such that one end of the tubing is located between the gas inlet port and the window and the other end of the tubing extends out of the opposite passage. The tubing is smaller than the inside diameter of the passage to allow gas to flow therebetween. Finally, there are means for removably securing the tubing in place and microwave excitation means in communication with the tubing adjacent and exterior to the head.

5 Claims, 2 Drawing Figures

ELECTRODELESS DISCHARGE RESONANCE LAMP

BACKGROUND OF THE INVENTION

This invention relates to gaseous light sources subject to microwave excitation. More particularly, the invention relates to an electrodeless discharge resonance lamp for producing light by microwave excitation of gas molecules which can be used in the initiation of chemical reactions by photolysis.

The vacuum ultraviolet region includes ultraviolet radiation characterized by wave lengths between 2000 Å and 2 Å. In the field of vacuum ultraviolet spectroscopy there is a need for light sources producing a continuum of ultraviolet radiation over different portions of the vacuum ultraviolet region and also for producing selective wave lengths of radiation within that region.

One type of ultraviolet light source employs a tuned microwave cavity operating in the continuous wave mode as an exciting source to energize a specified gaseous volume. In this type of light source, an envelope containing an appropriate gas is placed within a tuned microwave cavity. A microwave generator operated at a frequency, typically 2450 mHz, is used to produce the exciting microwaves and the radiation produced within the gas is directed through an appropriate window to a vacuum ultraviolet spectrometer or a chemical reaction vessel or for some other use. With air cooling, such microwave excited light sources may be operated up to a maximum power of about 100 watts. At this power level, the intensity level of radiation which can be generated from the rare gases, typically the argon, xenon, and krypton, is insufficient to serve as a useful high intensity source, especially in the photolysis initiation of chemical reactions. Microwave excitation of gas molecules can produce selective wave lengths of light, the use of which would be advantageous in the initiation of chemical reactions by photolysis because less overall energy would be necessary to initiate the reactions. Thus, there is a need for an electrodeless discharge resonance lamp for producing light by microwave excitation of gas molecules which can be used effectively in the initiation of chemical reactions by photolysis.

Electrodeless discharge resonance lamps in existence today are integrally formed devices which are made of precisely fabricated and fragile glassware. The usefulness of such equipment is limited because it is subject to breakage and because if the window must be cleaned or replaced, the whole device must be thrown out. Thus, there is a need for an electrodeless discharge resonance lamp which is strong enough to stand up to harsh usage such as in a chemical reactor and which can be relatively inexpensively maintained without the necessity of disposal of the entire unit.

SUMMARY OF THE INVENTION

This invention relates to an electrodeless discharge resonance lamp for producing light by microwave excitation of gas molecules. The lamp comprises a head which has a passage therethrough and a gas inlet port in communication with the passage. There is a window mounted in the head through which the light can pass. The window is removably mounted in the passage at one end of the head such that the window prevents all gas flow into and out of the passage at that end of the head. A collimator is removably mounted in the passage adjacent and exterior to the window. There is gas flow tubing positioned in the passage such that one end of the tubing is located between the gas inlet port and the window and such that the other end of the tubing extends out of the opposite end of the passage from the window. The outside diameter of the tubing must be smaller than the inside diameter of the passage to allow gas to flow therebetween. There must be means for removably securing the tubing in place and for preventing all gas flow out of the end of the passage opposite the window other than through the tubing. Finally, there is means for microwave excitation of gas within the tubing. This microwave excitation means is in communication with the tubing adjacent and exterior to the head.

In a preferred embodiment of the invention, the head is adapted to be removably secured to a vessel wherein the window is positioned within the vessel. It is also preferred that the head be threadably mounted on the vessel, that the collimator be threadably mounted on the head, and that the means for removably securing the tubing in place and for preventing gas flow out of the passage also be threadably mounted in the head.

This invention also relates to a photolysis initiation reactor which comprises a vessel containing an electrodeless discharge resonance lamp for producing light by microwave excitation of gas molecules wherein the lamp is removably secured to the vessel. The lamp referred to in the previous paragraph is the same one used in this photolysis initiation reactor.

DETAILED DESCRIPTION OF THE INVENTION

Figure 1:
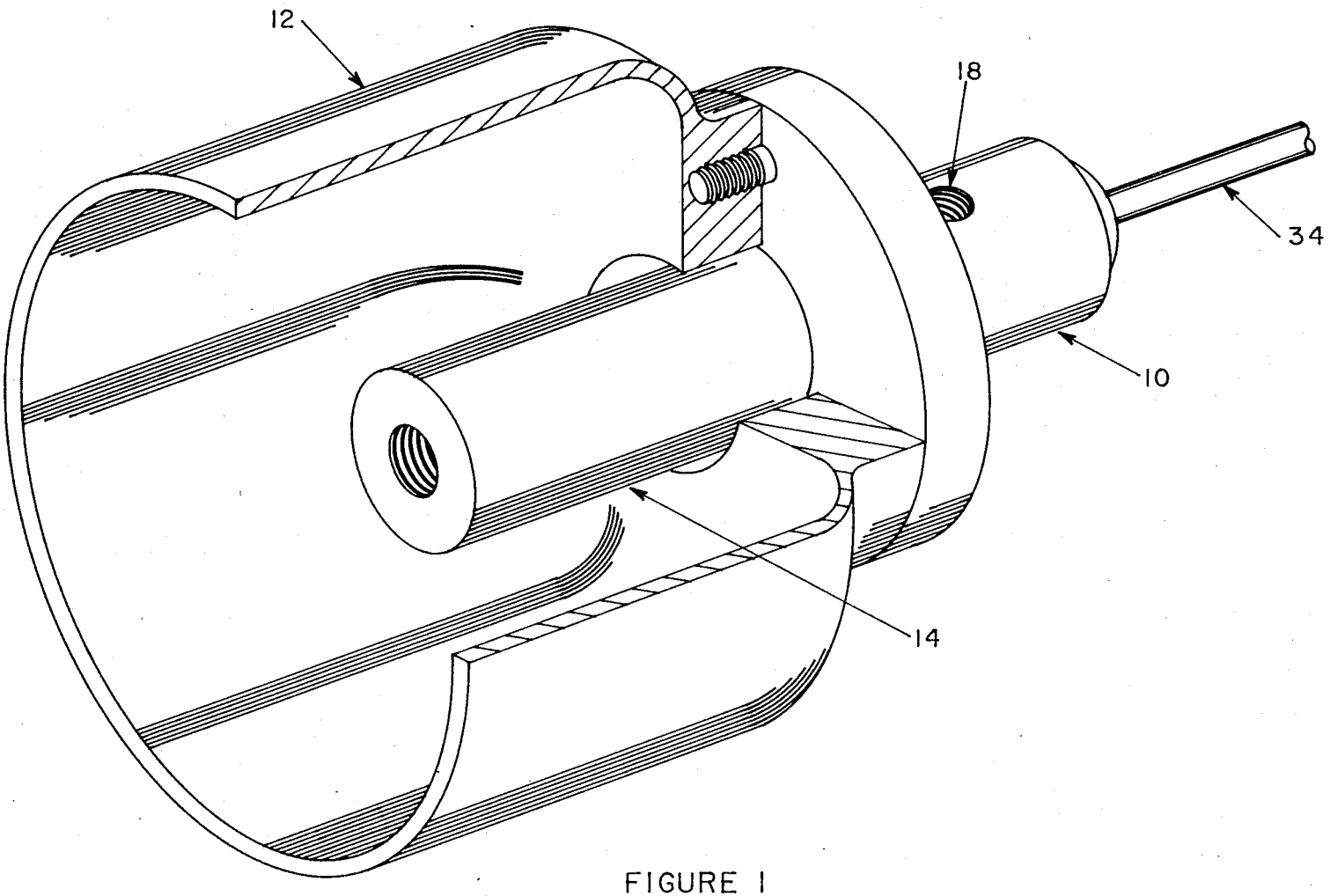
FIG. 1 is a perspective view showing the electrodeless discharge resonance lamp installed in a closed vessel which is partially cut away to show how one portion of the lamp extends into the interior of the vessel.

Referring to FIG. 1, the electrodeless discharge resonance lamp 10 of the present invention is shown mounted in the wall of vessel 12. A portion of vessel 12 is cut away so that the end of the lamp 10 extending into the vessel 12 can be seen.

Figure 2:
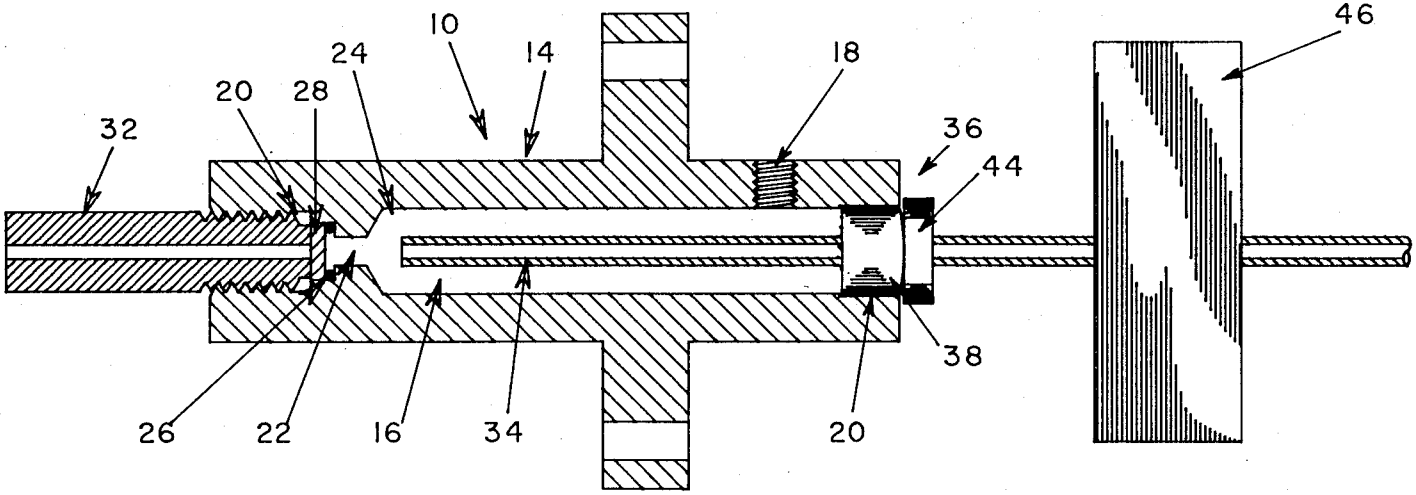
FIG. 2 is a sectional view of the lamp.

Referring also to FIG. 2, it can be seen that the lamp 10 has a head 14 which has a passage 16 extending longitudinally therethrough. Gas inlet port 18 in the head 14 is in communication with the passage 16. It can be seen that the passage 16 has a main section 24 which is communication with the gas inlet port 18, wide outer sections 20, and a narrow inner section 22 between one of the outer sections 20 and the main section 24.

An O-ring 26 is positioned in the outer passage 20 adjacent the narrow inner passage 22. The window 28 for passage of the light from the head 14 is removably positioned next to the O-ring 26. Finally, collimator 32 is threadably mounted in the head 14 such that it removably secures the window 28 within the passage 20 and prevents gas flow therethrough. The collimator 32 serves to keep the light in a small narrow beam and it can be extended as far into the vessel 12 as desired to reduce scattered light from the lamp 10 in the observation zone. The collimator 32 is also desirable when the lamp 10 is used to detect low fluorescent light levels. The collimater 32 is preferably not used in the initiation of reactions when it is desired that the light be scattered throughout the reaction vessel 12.

The collimator 32 described above is also important in increasing the ease of maintenance of the lamp 10. Since the collimator 32 can be easily removed, the window 28 can also be easily removed and cleaned when it is necessary. Thus, this device can be maintained much more easily than the prior art electrodeless discharged resonance lamps and the entire device does not have to be discarded when any of the critical parts of the device wear out.

Tubing 34 is positioned within head 14 in passage 16, such that one end of the tubing 34 is positioned between the gas inlet port 18 and the window 28. The other end of the tubing 34 extends out of head 14 through the other wide outer section 20 of passage 16. Tubing 34 is secured in place in the head 14 by a fitting 36 which is comprised of a body 38 removably mounted in wide outer section 20 and a nut 44 which is mounted on the body 38 and through which the tubing 34 extends. The fitting 36 secures the tubing 34 in place and prevents gas flow into or out of the passage 16 other than through the tubing 34. The fact that the fitting 36 is removably secured to the head 14 makes it possible to easily maintain this side of the head 14 and also to replace worn or broken tubing 34 more easily than is possible in other such devices.

The tubing 34 extends out of the head 14 and through the microwave cavity 46. The microwave cavity 46 has a tuner for tuning the cavity 46 to produce the desired wave length and amount of light in the gas that passes therethrough. The principle of the microwave cavity 46 is well known and need not be repeated herein.

In operation, gas enters the gas inlet port 18 and flows through passage 16 and into the open end of tubing 34. In the process, the gas sweeps by the window 28, thereby assisting in cleaning the window 28 and lessening the amount of contaminants which are deposited thereon and which foul the window 28. This design feature, which is not present in other known electrodeless discharge resonance lamps, should increase the useful life of the window 28 or at least increase the time between cleanings of the window 28.

The gas then passes through tubing 34 out of the head 14 and into the microwave cavity 46 where it is excited by the microwaves and produces light which is generated in all directions. The useful light for purposes of this invention passes back through the gas tubing 34, through the window 28 and out of the collimator 32, if used. It can be detected or it can be used to initiate chemical reactions in the vessel 12.

The novel electrodeless discharge resonance lamp of the present invention can be used in the detection of light energy produced by gas molecules which have been excited by microwaves or it can be used in the initiation of chemical reactions by photolysis. One of the primary advantages of using an electrodeless discharge resonance lamp is that it can produce selective wave lengths for initiation of chemical reactions, thereby reducing the overall power which is necessary for such initiation. Once the wave length of light which is necessary to initiate a certain reaction is found, the electrodeless discharge resonance lamp can be operated only at that particular wave length. Of course, the wave length can be changed.

I claim:

1. An electrodeless discharge resonance lamp for producing light by microwave excitation of gas molecules, which comprises:

(a) a head having a passage therethrough and a gas inlet port in communication with said passage, (b) a window removably mounted in said passage at one end of said head, whereby said window prevents all gas flow into and out of said passage at that end of said head, (c) gas flow tubing positioned in said passage such that one end of said tubing is located between said gas inlet port and said window and the other end of said tubing extends out of the end of said passage opposite said window, the outside diameter of said tubing being smaller than the inside diameter of said passage to allow gas to flow therebetween, (d) means for removably securing said tubing in place and for preventing all gas flow out of said end of said passage opposite said window other than through said tubing, and (e) microwave excitation means in communication with said tubing adjacent and exterior to said head.

2. The lamp of claim 1 wherein said head is adapted to be removably secured to a vessel such that said window is positioned within said vessel.

3. The lamp of claim 1 wherein a collimator is removably mounted in said passage adjacent and exterior to said window.

4. A photolysis initiation reactor comprising a vessel containing an electrodeless discharge resonance lamp for producing light by microwave excitation of gas molecules wherein said lamp is removably secured to said vessel and said lamp comprises:

(a) a head having a passage therethrough and a gas inlet port in communication with said passage, (b) a window removably mounted in said passage at one end of said head, whereby said window prevents all gas flow into and out of said passage at the end of said head, (c) gas flow tubing positioned in said passage such that one end of said tubing is located between said gas inlet port and said window and the other end of said tubing extends out of the end of said passage opposite said window, the outside diameter of said tubing being smaller than the inside diameter of said passage to allow gas to flow therebetween, (d) means for removably securing said tubing in place and for preventing all gas flow out of said end of said passage opposite said window other than through said tubing, and (e) microwave excitation means in communication with said tubing adjacent and exterior to said head.

5. The lamp of claim 4 wherein a collimator is removably mounted in said passage adjacent and exterior to said window.

* * * * *